US008171849B2

(12) United States Patent
Amick

(10) Patent No.: US 8,171,849 B2
(45) Date of Patent: May 8, 2012

(54) MULTI-RANGE SHOTSHELLS WITH MULTIMODAL PATTERNING PROPERTIES AND METHODS FOR PRODUCING THE SAME

(75) Inventor: Darryl D. Amick, Albany, OR (US)

(73) Assignee: Amick Family Revocable Living Trust, Albany, OR (US)

( * ) Notice: Subject to any disclaimer, the term of this patent is extended or adjusted under 35 U.S.C. 154(b) by 0 days.

(21) Appl. No.: 12/686,680

(22) Filed: Jan. 13, 2010

(65) Prior Publication Data

US 2010/0175575 A1 Jul. 15, 2010

Related U.S. Application Data

(60) Provisional application No. 61/144,563, filed on Jan. 14, 2009.

(51) Int. Cl.
*F42B 7/02* (2006.01)

(52) U.S. Cl. ..... 102/460; 102/448; 102/457; 102/455

(58) Field of Classification Search ..... 102/448–460
See application file for complete search history.

(56) References Cited

U.S. PATENT DOCUMENTS

| | | | | |
|---|---|---|---|---|
| 1,277,810 | A | 9/1918 | Woodhouse | |
| 1,575,716 | A | 3/1926 | Pavek | |
| 1,583,559 | A | 5/1926 | Kenneweg | |
| 3,412,681 | A | 11/1968 | Schirneker | |
| 3,796,157 | A | 3/1974 | Anderson | |
| 3,952,659 | A | 4/1976 | Sistino | |
| 3,996,865 | A | 12/1976 | Dwyer | |
| 4,173,930 | A | 11/1979 | Faires, Jr. | |
| 4,473,514 | A | 9/1984 | Donn | |
| 4,686,904 | A | 8/1987 | Stafford | |
| 4,760,793 | A * | 8/1988 | Herring, III | 102/460 |
| 4,823,702 | A | 4/1989 | Woolsey | |
| 4,996,924 | A | 3/1991 | McClain | |
| 5,020,438 | A | 6/1991 | Brown | |
| 5,264,022 | A | 11/1993 | Haygarth et al. | |
| 5,325,786 | A | 7/1994 | Petrovich | |
| 5,527,376 | A | 6/1996 | Amick et al. | |
| 5,713,981 | A | 2/1998 | Amick | |
| 6,202,561 | B1 | 3/2001 | Head et al. | |
| 6,258,316 | B1 | 7/2001 | Buenemann, Jr. et al. | |
| 6,270,549 | B1 | 8/2001 | Amick | |
| 6,367,388 | B1 | 4/2002 | Billings | |
| 6,415,719 | B1 | 7/2002 | Buccelli et al. | |
| 6,447,715 | B1 | 9/2002 | Amick | |
| 6,527,880 | B2 | 3/2003 | Amick | |
| 6,591,730 | B2 | 7/2003 | Beal | |
| 6,701,848 | B1 | 3/2004 | Georgantzis et al. | |
| 7,232,473 | B2 | 6/2007 | Elliott | |
| 7,765,933 | B2 * | 8/2010 | Poore et al. | 102/460 |
| 2006/0118211 | A1 | 6/2006 | Elliott | |
| 2009/0114113 | A1 | 5/2009 | Poore et al. | |

* cited by examiner

*Primary Examiner* — Michael Carone
*Assistant Examiner* — Daniel Troy
(74) *Attorney, Agent, or Firm* — Dascenzo Intellectual Property Law, P.C.

(57) ABSTRACT

Shotshells are provided which are loaded with at least two different shot charges, at least one of said charges being comprised of shot pellets with short-range shape(s) and at least another of said charges being comprised of shot pellets with long-range shape(s). Said shotshells are thereby capable of producing shotgun patterns that are suitable for both short-range and long-range shooting.

23 Claims, 3 Drawing Sheets

MULTI-RANGE SHOTSHELLS WITH MULTIMODAL PATTERNING PROPERTIES AND METHODS FOR PRODUCING THE SAME

RELATED APPLICATION

This application claims priority to U.S. Provisional Patent Application Ser. No. 61/144,563, which was filed on Jan. 14, 2009, and the complete disclosure of which is hereby incorporated by reference.

FIELD OF THE DISCLOSURE

The present disclosure relates generally to the field of shotshells and more specifically to shotshells with multimodal patterning properties.

BACKGROUND OF THE DISCLOSURE

Conventional non-toxic shotshells currently in use for hunting and target shooting have evolved over the past several years in response to changing environmental and economic requirements. One such significant change was the shift from the use of toxic lead (Pb) shot or pellets for waterfowl hunting to other, less toxic, materials. Because of its relatively low cost and wide availability, one choice of a material for non-toxic shotgun shot is steel, which may be forged and/or swaged into tough spheres from drawn wire and then ground to a spherical shape.

While steel may provide some benefits as a replacement for lead shot, it also has its limitations. Among others, these limitations include a density that is significantly less than that of lead shot and a tighter shot pattern. The first difference may make it more difficult to reach targets at a distance and/or decrease the effective range of the shot, while the second difference may make it more difficult to hit a moving target and/or closer targets.

While all hunters must contend with the properties of steel shot, more experienced hunters, who formerly utilized higher density, loosely-patterning lead shot have been particularly challenged in attempting to adjust to the attributes of spherical steel shot. Clinics have been, and continue to be, held around the world by such organizations as CONSEP (Cooperative North American Shotgunning Education Program) to teach hunters how to use steel shot more effectively, with the goal of increasing hunter proficiency. Obviously, only relatively small numbers of shooters can be personally tutored in this manner. Thus, the availability of an improved type of shotshell would aid significantly in achieving the underlying goal of improving hunter proficiency over a much larger constituency.

The greater shot pattern density of steel shot may be due to the increased hardness of the shot, which resists deformation by setback forces when a shot shell containing the shot is fired. In contrast, soft lead shot may be deformed significantly by these setback forces, producing a plurality of flat areas or facets on the shot surface. These facets may cause anomalous spinning of the pellets, causing them to deviate from a normal trajectory under the influence of the so-called Magnus effect, and broadening the spread of the shot pattern (i.e. decreasing the pattern density) at a given distance when compared to steel shot. Lead shot also has been shown to produce a longer shot pattern in the direction of shot motion when compared to steel shot.

The pattern of pellets crossing an impact region of a plane perpendicular to the line of flight of the shot, which may be referred to as the shot stream, is most dense close to the gun and less dense as the stream travels down range (i.e., away from the gun/shooter). This phenomenon may be visualized as a distribution of pellets moving away from the gun within a conical volume of space. Tighter patterns may be characterized by a smaller cone apex angle, while wider patterns may be characterized by a larger cone apex angle. A tighter pattern may be additionally characterized by a higher density of shot pellets within the impact region, while a wider pattern may be characterized by a lower density of shot pellets within the impact region. With this in mind, a shot pattern may be quantified by the percentage of the total number of shot pellets that are contained within a circle of a given diameter at a given distance from the shooter. For example, a 90%, 20-yard pattern diameter of 24-inches suggests that, at 20-yards from the shooter, 90% of the shot pellets will be contained within a 24-inch diameter circle. Shot patterns also may be characterized in terms of their dispersion, or spread, which may be related to the pattern diameter discussed above.

While modern shotshells loaded with steel shot may perform adequately at ranges beyond approximately 30 yards, the shot patterns may be too tight (i.e. too dense) at shorter ranges to be effective. Depending on the situation, it may be desirable to manufacture shotshells with shot patterns optimized for shorter distances, such as 0 to 30 yards, shotshells with shot patterns optimized for longer distances, such as distances greater than 30 yards, as well as multi-distant and/or multimodal shotshells optimized for shooting over a plurality of distances, or ranges of distances, such as distances of 5-100 yards, including distances of 10-70, 15-60, and 20-40 yards.

The tight shot patterns that may be inherent with the use of conventional steel shot may result in overkill. By overkill, it is meant that there may be no benefit in striking a target with more than the required minimum number of lethal pellets, especially if redundant numbers of pellets do nothing to expand the effective area of the pattern and/or cause unnecessary damage to the target. Thorough discussions of this and other technical aspects of patterning requirements are presented in two separate issues of Sporting Clays magazine (Vol. 10—No. 12—Issue 84, pp. 22-31, December, 1998 and Vol. 11—No. 1—Issue 85, pp, 38-70, January, 1999) by Tom Roster. While the prior art reveals various attempts to manipulate shot patterns, one must appreciate the large degree of shot stream dispersion that must be obtained in order to significantly impact the ability of a hunter to hit a short-range (less than 30 yards) target. If shot pellets travel within conical volumes of space, planar patterns may be mathematically estimated for specific shotshell designs for any given target diameter at any given range, once a pattern for some known target diameter (e.g., 30-inch) at some known range (e.g., 40 yards) has been empirically determined. For example, a pattern of 75% of pellets in a given shotshell load striking within a 30-inch diameter circle at 40 yards (a popular industry standard test) would exhibit a corresponding 75% pattern within a 15-inch diameter circle at 20 yards. While this example of a short-range pattern may be considered overly tight under certain circumstances, it may be quite typical of conventional shotshells loaded with spherical steel shot.

From another quite different perspective, one might wish to estimate the degree of shot dispersion necessary to obtain a 90%, 25-yard pattern diameter of 30 inches. This would imply a corresponding 90%, 40-yard pattern diameter of $(40/25)\times30=48$ inches. In this case, only about $90\%\times(30/48)^2=35\%$ of the pellets would fall within a 30-inch diameter circle at 40 yards. As shown herein, obtaining sufficiently dispersive short-range patterns may require specialized pellet shapes and/or methods.

Historically, several different types of shotshells have been developed specifically for the purpose of modifying shot patterns. Various approaches have been tried, including placing plastic structures in the center of the shot column (Spred-R™ product by Polywad, Inc.) and using relatively small, high drag, spherical shot for swatter loads.

The Spred-R™ design simply effects a shift of a small portion of the pellets in the pattern from the dense, central core region (generally associated with a Gaussian shot distribution) outward to the fringe area of a typical 40-yard, 30-inch diameter pattern, thereby improving pattern uniformity, with little or no impact on effective range. Similarly, a limitation inherent in swatter loads is that, while useful at close range, effectiveness beyond about 25 yards is generally inadequate due to the small shot sizes employed. A typical hunter in a blind overlooking waterfowl decoys has no way of knowing at what range an initial opportunity will present itself. Therefore, shells designed only for close ranges may be of limited usefulness and may even decrease shooting proficiency if used improperly. In addition, the relatively small shot sizes used is in swatter loads may cause game meat containing such fine shot to be unpleasant or difficult to eat, resulting in wasteful loss of game.

U.S. Pat. No. 6,202,561 to Head et al. (the '561 patent) discloses modifying shot patterns by mixing combinations of steel spheres and other, higher-density spheres made from materials such as tungsten, bismuth, or copper. These spheres may be contained within the shotshell as layered mixtures of various spherical shot types with varying densities to obtain a combination of long-range/short-range performance.

This approach takes advantage of the density×diameter fluid drag relationship for spherical pellets, wherein the fluid drag forces are inversely proportional to the product of the density of the pellet and the diameter of the pellet, allowing similar diameter pellets of different densities to have different effective ranges. However, the '561 patent only addresses shot densities that are equal to or greater than the density of steel (7.8-7.9 g/cc). Not only are the differences in pattern dispersion attributed to differences in shot density (in the range of 7.9-11.0 g/cc) and shot diameter too small to significantly change short-range pattern diameter; but, as discussed herein, conventional steel patterns are already too tight to provide effective short-range shooting efficiency. Increasing pellet density by using the more costly (denser) metals, such as tungsten, bismuth, or copper, only exacerbates this short-range pattern diameter problem.

A shotshell described in printed advertisements and on websites by ATK/Federal Cartridge and sold under the BLACK CLOUD™ mark features a special shot cup (the FLITE CONTROL™ cup) that is believed to have been designed to tighten normal steel shot patterns. Included in this shotshell is a mixture of ordinary steel spheres and "belted spheres" of steel marketed as FLIGHT STOPPER™ shot. The latter shape is purported to increase wound trauma in game.

For a particular target, there exists an optimal impact region or shot pattern diameter, as well as an optimal density of shot pellets within that impact region. As discussed herein, this impact region diameter may be a function of both the distance from the gun and the ballistic characteristics of the pellets in flight. Since a target may present itself at a variety of distances from the gun, the ability to tailor the ballistic characteristics of the pellets in order to improve and/or select a specific shot pattern density within the impact region may be desirable.

BRIEF SUMMARY OF THE DISCLOSURE

The present disclosure is directed to novel-shaped shot pellets and to shotshells incorporating the same. The shot pellets may include a variety of pellet shapes adapted to impact the ballistic properties of the pellet when it is fired from a shotgun. These shapes may include long-range pellet shapes that may behave, when fired, similarly to conventional shot pellets, as well as short-range pellet shapes that, when fired, may cause an increase in the pellet pattern diameter relative to the long-range shapes. The shotshells may incorporate a plurality of shot pellets including a plurality of shot pellet shapes adapted to provide an effective shot pattern at varying distances from the shooter.

DETAILED DESCRIPTION AND BEST MODE OF THE DISCLOSURE

Figure 1:
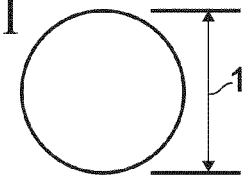
FIG. 1 is a schematic representation of an illustrative, non-exclusive example of a spherical shot shape according to the present disclosure.
Figure 2:
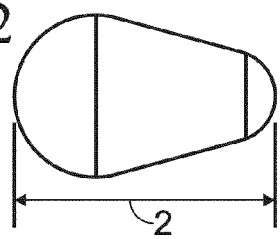
FIG. 2 is a schematic representation of an illustrative, non-exclusive example of a teardrop shot shape according to the present disclosure.
Figure 3:
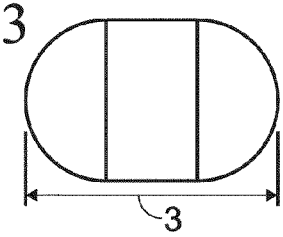
FIG. 3 is a schematic representation of an illustrative, non-exclusive example of a round-ended cylinder shot shape according to the present disclosure.
Figure 4:
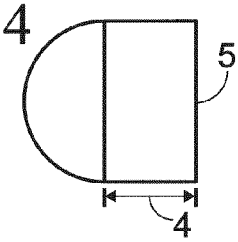
FIG. 4 is a schematic representation of an illustrative, non-exclusive example of a bullet shot shape according to the present disclosure.

It is generally accepted that the forces impacting the ballistic characteristic of a shotshell pellet in flight are related to fluid drag phenomena. The variables that cause in-flight drag in both the longitudinal/linear and transverse/radial directions (i.e. direction of shot motion and direction perpendicular to shot motion, respectively) directly impact the shot pattern diameter or dispersion and include the properties of the fluid through which the shot is traveling (i.e., air or other medium), such as its density and viscosity, and the properties of the pellet, such as its size, density, and shape. As discussed in more detail herein, it has been found that varying the pellet shape may have a significant impact on the shot pattern produced when a shotshell containing a plurality of shot pellets is fired. In selecting specific pellet shapes for evaluation, consideration may be given to a variety of factors, illustrative, non-exclusive examples of which may include the packing density in the shotshell (compared against equal-sized spheres); the ease, practicality and cost of production; and the manner in which the shot pellets interact with shell components, gun barrels, and soft/live targets.

A variety of pellet shapes were investigated to determine the impact of pellet shape on the shot pattern dispersion for a given, or selected, distance. FIGS. 1-10 provide a schematic representation of illustrative, non-exclusive examples of the investigated shapes of shotshell pellets, which additionally or alternatively may be referred to herein as shot pellets and/or as shot. These shapes may be broadly characterized into two categories: those that do not significantly increase pellet dispersion, and those that do increase pellet dispersion. Shapes that were not found to significantly increase pellet dispersion include the spheres of FIG. 1, even if they contained mechanically-created flat spots, the teardrops of FIG. 2, the round-ended right cylinders of FIG. 3, and the bullets of FIG. 4. These shapes may be generally referred to as long-range shot, since the shot pattern produced by these shapes may be more suitable for longer range targets, such as for targets that are more than 30 yards from the shooter. Illustrative, non-exclusive examples of sphere-shaped shot diameters 1 according to the present disclosure include diameters in the range of 0.05" to 0.25", including diameters of 0.12", 0.13", 0.14", 0.15", 0.16", 0.17", and 0.18". Illustrative, non-exclusive examples of teardrop lengths 2 according to the present disclosure include teardrop lengths that are 1 to 4 times the teardrop diameter, including teardrop lengths of 1.1, 1.3, 1.5, 1.7, 2, and 3 times the teardrop diameter. Illustrative, non-exclusive examples of round-ended cylinder lengths 3 according to the present disclosure include lengths of 1 to 5 times the cylinder diameter, including lengths of 2, 3, and 4 times the cylinder diameter. Illustrative, non-exclusive examples of bullet side lengths 4 and end lengths 5 according to the present disclosure include lengths of 0.05" to 0.25", including lengths of 0.10", 0.12", 0.14", 0.16", 0.18", and 0.20". The lengths, diameters, and length ratios defined above are illustrative, non-exclusive examples and dimensions outside these ranges are also within the scope of the present disclosure, as are other pellet shapes that provide long-range ballistic characteristics.

Figure 5:
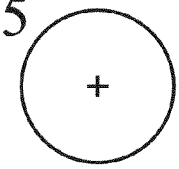
FIG. 5 is a schematic representation of an end view of an illustrative, non-exclusive example of a right cylinder shot shape according to the present disclosure.
Figure 6:
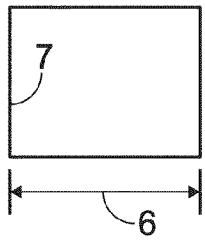
FIG. 6 is a schematic representation of a side view of an illustrative, non-exclusive example of a right cylinder shot shape according to the present disclosure.
Figure 7:
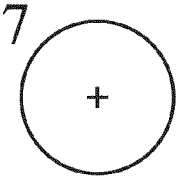
FIG. 7 is a schematic representation of an end view of an illustrative, non-exclusive example of a diagonal cylinder shot shape according to the present disclosure.
Figure 8:
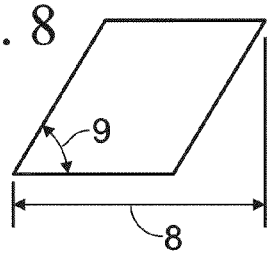
FIG. 8 is a schematic representation of a side view of an illustrative, non-exclusive example of a diagonal cylinder shot shape according to the present disclosure.
Figure 9:
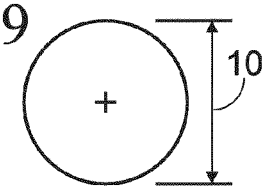
FIG. 9 is a schematic representation of an end view of an illustrative, non-exclusive example of a pancake shot shape according to the present disclosure.
Figure 10:
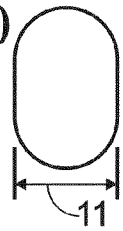
FIG. 10 is a schematic representation of a side view of an illustrative, non-exclusive example of a pancake shot shape according to the present disclosure.

In contrast, illustrative, non-exclusive examples of shapes that were found to significantly impact pellet dispersion include the right cylinders of FIGS. 5 and 6, which have an overall length 6 and diameter 7, the diagonal cylinders of FIGS. 7 and 8, which have an overall length 8 and a cut angle 9 (such as the illustrated, non-exclusive example of a cut angle of 60°), and the pancakes of FIGS. 9 and 10, which have a diameter 10 and a thickness 11. These shapes may be generally referred to as short-range shot, since they may produce a larger shot pattern diameter and the shot pattern produced by these shapes may be more suitable for shorter range targets, such as targets that are less than 30 yards from the shooter. The listed shapes are illustrative, non-exclusive examples of short-range shot and other shot shapes, including diagonal cylinders having cut angles 9 that are greater or less than the illustrated example, that produce a desired short-range pattern are also within the scope of the present disclosure.

The physical shapes, dimensions, and properties of short-range shot may result in shot patterns that are suitable for short-range targets. As an illustrative, non-exclusive example, at a range of 20 yards, divergent patterns may exhibit effective coverage of a circular target area at least 24 inches in diameter with a pellet population density sufficiently high to ensure that an average of at least two (2) pellets with lethal penetration and energy will strike vital areas of a target of a given size at any location within said target area at least 80% of the time. While this criterion may be confirmed either by empirical patterning tests or by calculations using widely accepted software, a related criterion which may be more convenient to apply is that short-range shot types may place less than 50%, such as less than 45% or less than 35%, of their aggregate number of pellets in a load within a 30-inch diameter circle at 40 yards.

In contrast, the physical shapes, dimensions, and properties of long-range shot may result in shot patterns that are suitable for long-range targets. As an illustrative, non-exclusive example, at a range of 40 yards, the population density of pellets striking a 30-inch diameter circle will result in at least two (2) pellets with lethal penetration and energy striking vital areas of a target of a given size at any location within said 30-inch diameter circle at least 80% of the time. Thus, measured at the same distance from the shooter, the use of long-range shot may result in a relatively tighter distribution or shot pattern when compared to short-range shot. As an illustrative, non-exclusive example, and using the same confirmation methods as were applied to short-range shot types, long-range shot types may place more than 50%, more than 60%, or more than 70% of their aggregate number of pellets in a load within a 30-inch diameter circle at 40 yards.

As discussed herein, it has been found that a variety of different shapes of steel pellets do not exhibit significantly divergent patterns, in spite of the fact that these shapes may be far from spherical. As an illustrative, non-exclusive example, conventional spherical steel shot pellets (FIG. 1) of #2 size (0.15-inch diameter) and/or #3 size (0.14-inch diameter) launched from 3-inch, 12-ga. shells (1¼ oz.) at 1550 ft/sec were found to consistently meet long-range criteria out to at least 40 yards. However, effective patterns at 25 yards were confined within a circular area of less than about 20-inch diameter, representing an overly tight pattern. Other curvilinear steel shapes of similar mass (FIGS. 2-4) such as teardrops, round-ended right cylinders, bullets and even steel spheres faceted by compressive deformation in a punch-and-die tool exhibited very similar patterns to those of spherical steel, all of which were deemed to be overly tight for use at short distances.

Conversely, three classes of shapes (FIGS. 5-10) displayed suitable short-range patterns. As an illustrative, non-exclusive example, both right cylinders (0.125-inch diameter by 0.143-inch long), and diagonal cylinders of a similar mass cut at an angle 9 of approximately 45 degrees were cut from low-carbon steel wire and tumbled to remove burrs. When loaded into shotshells, packing densities for both types of cut wire were found to be approximately 15% greater than those of equal-sized steel spheres. Firing either type of cut-wire pellets at 1450-1550 ft/sec (muzzle velocity) produced a much larger degree of shot dispersion. As an illustrative, non-exclusive example, whereas conventional steel shot placed about 75-80% of shot within a 30-inch circle at 40 yards, only about 30% of the cut wire was contained within this circle. In addition, effectively dispersed patterns were obtained at short-range, such as an approximately 26-inch diameter circle at 20 yards for cut-wire shot, versus less than an 18-inch diameter circle for conventional steel spheres.

Cut-wire and pancake pellets may fly randomly oriented, at least over 40 yards, but may instantaneously attempt to reorient themselves, in a direction which reduces fluid drag, upon striking a soft-tissue target (such as a PERMA-GEL™ target), thereby producing relatively large, tortuous wound channels. In the specific case of diagonal cylinders, essentially all such pellets assume a sharp end forward orientation in the target, which may encourage penetration in live targets.

While tailoring the ballistic properties of shotshell pellets in order to produce loads with varying pattern densities at varying distances from the shooter may produce shotshells that are designed for a specific target at a specific distance, certain shooting situations may be better served by a shotshell that provides a multimodal shot pattern and produces a desired shot pattern density over a range of distances. In such a shotshell, the relative proportions of the short-range shot and the long-range shot may render the shotshell capable of placing at least two (2) pellets with lethal penetration and energy in vital areas of a target of a given size at any location within a circular target of approximately 24-inch or more in diameter at all distances between 20 and 40 yards.

Figure 11:
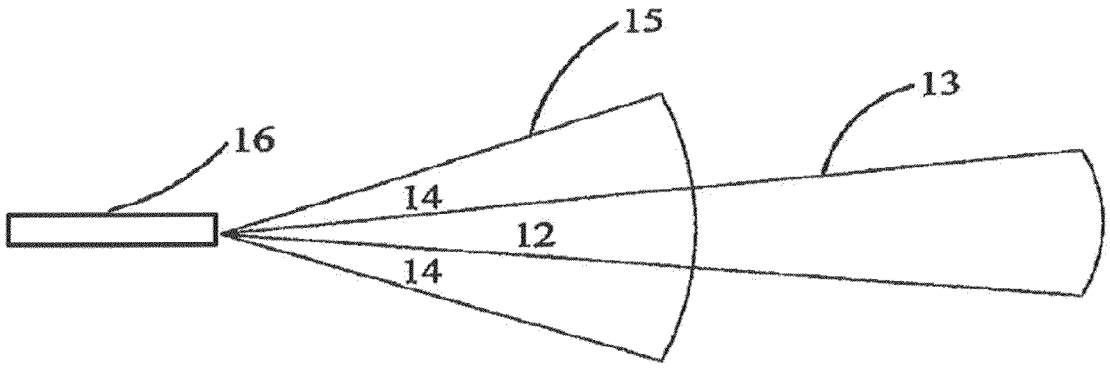
FIG. 11 is a schematic representation of an illustrative, non-exclusive example of a bimodal shot pattern according to the present disclosure.

An illustrative, non-exclusive example of a multimodal shot pattern according to the present disclosure, in the form of a bimodal shot pattern, is shown schematically in FIG. 11. In FIG. 11, gun barrel 16 fires a composite shot load including a load of short-range shot that may produce a wider cone angle 14 and a correspondingly wider shot pattern 15 and a load of long-range shot that may produce a narrower cone angle 12 and a correspondingly narrower shot pattern 13. Thus, the long-range shot may be maintained in a much tighter cone angle and may consequently be more lethal to a long-range target, while the short-range shot may include a much wider cone angle and may be best adapted for targets at shorter ranges. While FIG. 11 shows a bimodal shot pattern, a plurality of different shot shapes, sizes, and/or densities may be utilized within an individual shotshell to produce a plurality of shot patterns without departing from the scope of the present disclosure. As used herein, "multi-modal" is intended to include "bimodal," and may include more than two modes, such as "tri-modal" or "quad-modal" without departing from the scope of the present disclosure.

Based on the observed shot pattern densities of both short-range and long-range shot, a series of experiments was conducted in which various proportions of #2 or #3 steel spheres and cut-wire pellets were mixed within individual shotshells in order to obtain a bimodal pattern effective over ranges of, for example, 20-40 yards, as schematically illustrated in FIG. 11. Several different loading schemes, including longitudinal and radial layering (FIGS. 13-15, discussed in more detail herein) of short-range and long-range pellet types produced shotshells which accomplished the overall objective of obtaining lethal patterns 24-30 inches in diameter at all ranges between about 20 yards and at least about 40 yards for game birds similar in size to mallard ducks (e.g., 22 square inch critical target area). Similar results were obtained using similar combinations of steel spheres and steel pancakes (FIGS. 1, 9, and 10) in a limited number of shotshells. Based on these results, it appears that acceptable results are obtained when aspect ratios (the ratio of pancake diameter-to-thickness) are about 1.5-3.5. Aspect ratios less than 1.5 may not result in sufficiently dispersive short-range patterns, while aspect ratios greater than 3.5 may produce somewhat erratic patterns.

It is within the scope of the present disclosure to manipulate loading patterns, i.e., distributions and locations of the two or more different types of shot morphologies within a single shotshell. These loading patterns may be utilized to improve the packing density of shot within the shell, to impact general pattern uniformity, and/or to impact shot pattern diameters. This is shown schematically in FIG. 12 where shotshell 40 may include head portion 24, shotshell casing 17, and mouth region 36. Shotshell 40 may further include an ignition device 32, such as primer 25, located behind propellant 22. Propellant 22 may be located behind partition 31, such as wad 20, which may serve to segregate the propellant from payload 38. The payload may comprise a plurality of segregated domains 30 of long-range shot pellets 18 and short-range shot pellets 19. Additionally or alternatively, payload 38 may comprise a plurality of shot mixtures 33 of long-range shot pellets 18 and short-range shot pellets 19. The payload may be contained within the shotshell by mouth closure 35.

Figure 12:
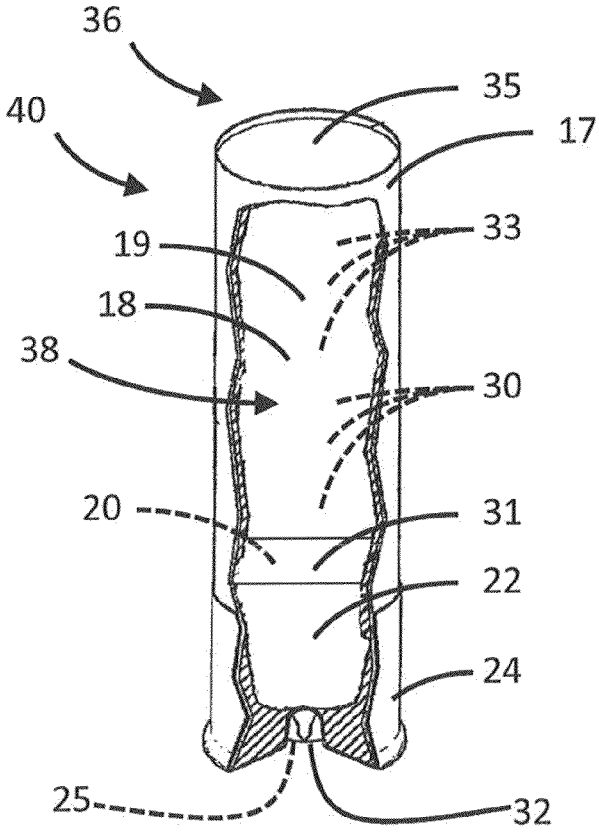
FIG. 12 is a partially cut away isometric view of an illustrative, non-exclusive example of a shotshell according to the present disclosure.

FIG. 12 illustrates that loading patterns according to the present disclosure may include segregation of different shot morphologies into different domains 30 within the shotshell as well as random and/or controlled mixing 33 of various pellet morphologies within the shell. Illustrative, non-exclusive examples of the segregation of different shot morphologies include segregation into longitudinally disposed layers, radial segregation, and/or any other segregation technique that places pellets of differing morphologies within defined regions within the shotshell payload, or shot-containing region. This segregation may be complete, such that there is no intermixing of, or among, the various regions and may include defined boundaries and/or materials that separate the regions. Additionally or alternatively, this segregation may be more general, such that the bulk of the pellets of one morphology are separate from the bulk of the pellets of a different morphology but there is some intermixing of pellet morphologies at the boundaries between the segregated regions. Illustrative, non-exclusive examples of mixing of various pellet morphologies within the shell include random mixing, as well as mixing techniques that provide one or more pellet morphology concentration gradients through the volume of the payload.

Figure 13:
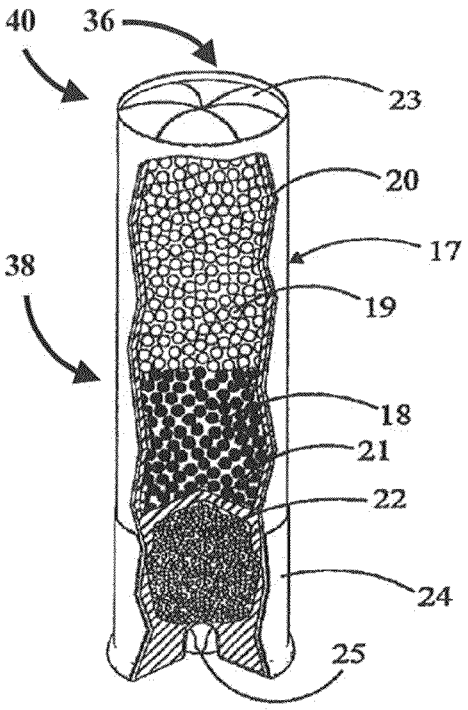
FIG. 13 is a partially cut away isometric view of an illustrative, non-exclusive example of a shotshell with longitudinally layered shot loading according to the present disclosure.
Figure 14:
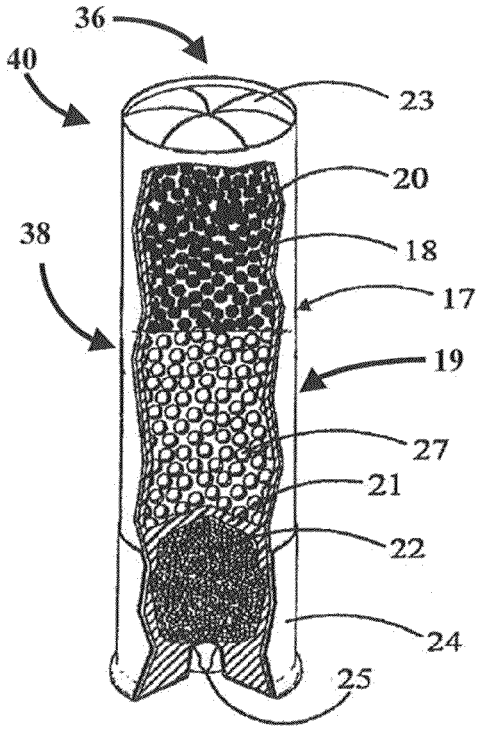
FIG. 14 is a partially cut away isometric view of an illustrative, non-exclusive example of a shotshell with longitudinally layered shot loading according to the present disclosure.
Figure 15:
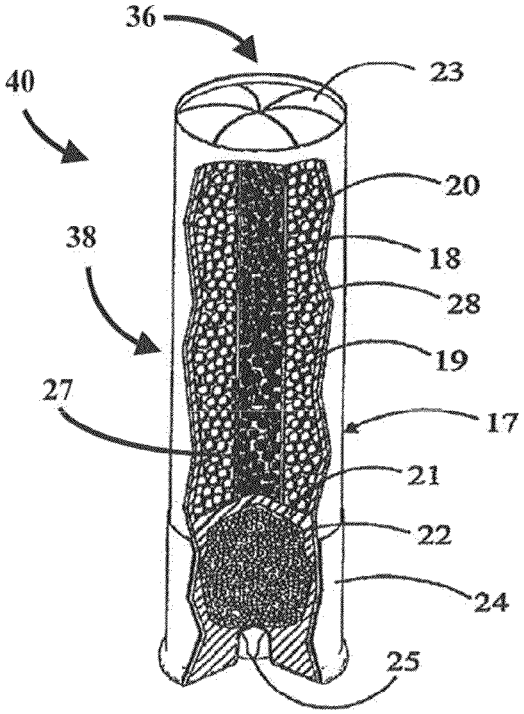
FIG. 15 is a partially cut away isometric view of an illustrative, non-exclusive example of a shotshell with radially layered shot loading according to the present disclosure.

Illustrative, non-exclusive examples of longitudinally segregated loading patterns according to the present disclosure are shown in FIGS. 13 and 14. FIG. 13 shows a shotshell 40 including a shotshell casing 17 of the conventional type used for housing steel shot pellets. In the FIG. 13, payload 38 includes long-range shot pellets 18 that are positioned behind short-range shot pellets 19, with each being housed in front of and within an inner plastic wad or shot cup 20 that has a closed end 21. The propellant 22 is directly behind closed end 21 of wad 20. Head portion 24, including primer 25, is behind the propellant. The upper end of outer casing 17 is crimped inward at 23 to close mouth region 36, although this construction is not required. In this example, the short-range shot pellets and the long-range shot pellets are confined to separate strata within the payload. FIG. 14 is substantially similar to FIG. 13 except that short-range shot pellets 19, in the form of cut-wire pellets 27, are positioned behind long-range shot pellets 18. FIG. 15 provides an illustrative, non-exclusive example of radially segregated loading patterns according to the present disclosure. In FIG. 15, short-range shot pellets 19 are disposed radially outward of long-range shot pellets 18. As indicated in FIG. 15, short-range shot pellets 19 may be in the form of cut-wire pellets 27, which are contained within cylindrical shot column 28.

The payload may include any suitable relative proportion of short-range shot to long-range shot that produces a desired shot pattern density and/or spread over a desired range, such as proportions in the range of 20:1 to 1:20, including proportions of 1:10, 1:5, 1:3, 1:1, and 2:1. It is within the scope of the present disclosure that these relative proportions may be measured based on weight, volume, and/or number of shot pellets.

Alternatively, the amount of a given shot type may be represented as a percentage of the total shot payload. Illustrative, non-exclusive shot type percentages according to the present disclosure include percentages in the range of 5% to 95%, such as percentages of 10%, 20%, 30%, 50%, and 60%. In addition, any suitable shot size may be included as part of the payload. Thus, the short-range shot may have a larger average volume than the long-range shot, the long-range shot may have a larger average volume than the short-range shot, and/or the two shot types may have approximately equal average volumes, such as average volumes that are matched to within 20%, within 15%, within 10%, within 5%, or within 1%. It is also within the scope of the present disclosure that any suitable number of domains 30 may be utilized to produce the desired shot pattern density and/or spread over the desired range, such as three domains, four domains, or more than four domains. Other shotshell constructions that utilize multiple pellet morphologies are also within the scope of the present disclosure. This may include shotshells that are constructed of various head and/or casing materials, shotshells that include a plug or other structure as mouth closure 35 to contain the payload within the casing, and shotshells that utilize any suitable wad material and/or wad geometry, such as partition 31.

Both longitudinal and/or radial layering of short-range and long-range shot types within a shotshell may have a significant impact on shot pattern characteristics and/or shotgun and shotshell component durability. As an illustrative, non-exclusive example, placing the long-range shot behind the short-range shot as shown in FIG. 13 may encourage the short-range shot to spread more readily upon exiting the shotgun barrel. This may be due to the fact that the short-range shot may be passed by the long-range shot in flight due to the higher drag placed on the short-range shot by the air. As another illustrative, non-exclusive example, when cut-wire short-range pellets are loaded in the bottoms of shot wads (where the highest set-back forces occur), as in FIG. 14, inherent line contacts of these cylindrical shapes did not indent walls of the shot wad as deeply as spheres. Thus, less-expensive shot wad materials and/or designs may be used. Similarly, radially surrounding spherical pellets with cut-wire shapes (FIG. 15) also may offer extra protection to the plastic shot wad and gun barrel.

Cut-wire shapes in steel or other common metals offer some inherent cost advantages over any shape which requires heading (i.e., forming using partially or totally closed dies) or other forming methods which require expensive shaped tooling (e.g., powder compaction). It was demonstrated that common wire shearing, widely used for such imprecise operations as scrap chopping, may yield pellets acceptable as short-range shot. As an illustrative, non-exclusive example, both right cylinder and diagonal-cut wire pellets made on a Swede Machinery chopper yielded patterning results indistinguishable from those produced by precision heading. Costs associated with producing cut-wire shapes by this and similar methods are expected to be only a fraction of those associated with headed or compacted shapes, including spherical shot. The latter requires heading wire to obtain rough spheres, followed by spherical grinding operations.

Pancake shapes may be produced by at least two relatively economical methods. Molten shot normally dropped and quenched in ways which maximize sphericity may be caused to form flattened shapes by simply modifying such parameters as drop height and quenchant properties. Although less economical than the molten method, common spherical shot may be easily and economically flattened by compressing it across two opposite points to obtain desired aspect ratios. One particularly convenient method for accomplishing this at high production rates includes pinching the shot between two oppositely rotating steel rolls set at a selected gap.

While the current examples of multi-range shotshells according to the present disclosure were designed specifically for large ducks such as mallards (*Anas Platylynchos*) at typical ranges of 20-40 yards, the present disclosure may be modified to be appropriate for a variety of other game, some of which May be smaller, and some larger, than so-called large ducks. Some of the factors to consider when making these modifications may include the relative sizes of the critical areas of the specific target; the traditional steel shot sizes shown to have adequate lethality for a specific target at a given range, with respect to velocity, energy, and drag resistance; and typical ranges encountered for the different types of game under different circumstances. Generally accepted values for these factors are available from a variety of sources, including CONSEP data, "*Shotshell Ballistics for Windows*," by Ed Lowry, and field studies conducted by a cadre of ammunition companies and outdoor writers.

While the examples contained herein focus on the use of steel shot, any suitable shot material may be utilized without departing from the scope of the present disclosure. This may include shot that may be produced from another metal, such as lead, nickel, copper, bismuth, or tungsten, as well as shot that may be produced from other materials, such as suitable polymers, minerals, or the like. Illustrative, non-exclusive examples of suitable tungsten-containing alloys are disclosed in U.S. Pat. Nos. 6,447,715, 6,270,549, and 6,527,880, the complete disclosures of which are hereby incorporated by reference. Shot produced utilizing a combination of materials is also within the scope of the present disclosure. Similarly, while specific manufacturing methods have been disclosed to produce both cut-wire and pancake type short-range shot, it is within the scope of the present disclosure that any suitable manufacturing method be utilized.

INDUSTRIAL APPLICABILITY

The disclosed short-range shot and multi-range shotshells are applicable to hunting, shooting clays, marksmanship, military, and other areas where a multi-range shotshell may be desirable. In the event that any of the references that are incorporated by reference herein define a term in a manner or are otherwise inconsistent with either the non-incorporated disclosure of the present application or with any of the other incorporated references, the non-incorporated disclosure of the present application shall control and the term or terms as used therein only control with respect to the patent document in which the term or terms are defined.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and sub combinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

The invention claimed is:

1. A shotshell comprising:

a shotshell casing having a head portion and a mouth portion;

a primer contained within the head portion;

a propellant contained within the casing and proximal to the primer;

a wad contained within the casing and proximal to the propellant; and a payload of shot pellets located within the casing and proximal to the wad, wherein the payload of shot pellets includes a plurality of shot pellets with overall shot pellet shapes, and further wherein the plurality of shot pellets includes at least short-range shaped pellets adapted to provide an effective shot pattern at short ranges and long-range shaped pellets adapted to provide an effective shot pattern at long ranges; wherein the long-range shaped pellets have a different overall shot pellet shape than the short-range shaped pellets, wherein the short-range shaped pellets have an oblique cylinder overall shot pellet shape.

2. The shotshell of claim 1, wherein the long-range shaped pellets include at least one overall shot-pellet shape selected from the group consisting of spheres, teardrops, round-ended cylinders, bullets, and polyhedrally faceted spheres.

3. The shotshell of claim 1, wherein the mass of an individual short-range shaped pellet is within 10% of the mass of an individual long-range shaped pellet.

4. The shotshell of claim 3, wherein the mass of an individual short-range shaped pellet is within 1% of the mass of an individual long-range shaped pellet.

5. The shotshell of claim 1, wherein the mass of an individual short-range shaped pellet differs from the mass of an individual long-range shaped pellet by more than 10%.

6. The shotshell of claim 1, wherein the payload of shot pellets has a total mass and further wherein the short-range shaped pellets comprise 10% to 20% of the total mass.

7. The shotshell of claim 1, wherein the payload of shot pellets has a total mass and further wherein the short-range shaped pellets comprise 20% to 50% of the total mass.

8. The shotshell of claim 1, wherein the payload of shot pellets has a total mass and further wherein the short-range shaped pellets comprise more than 50% of the total mass.

9. The shotshell of claim 1, wherein the plurality of shot pellets comprise a plurality of stratified domains within the payload of shot pellets and further wherein at least one of the plurality of stratified domains includes a different overall shot pellet shape than the other of the plurality of stratified domains.

10. The shotshell of claim 9, wherein the plurality of stratified domains are interengaging and interfitting domains.

11. The shotshell of claim 9, wherein the shotshell includes a longitudinal axis and further wherein the stratified domains comprise a plurality of longitudinally stratified layers.

12. The shotshell of claim 11, wherein a stratified domain containing the short-range shaped pellets is disposed proximal to the head portion of the shotshell relative to a stratified domain containing the long-range shaped pellets.

13. The shotshell of claim 11, wherein a stratified domain containing the short-range shaped pellets is disposed distal from the head portion of the shotshell relative to a stratified domain containing the long-range shaped pellets.

14. The shotshell of claim 9, wherein the shotshell includes a longitudinal axis and further wherein the stratified domains comprise a plurality of layers that are disposed radially relative to the longitudinal axis.

15. The shotshell of claim 14, wherein a stratified domain containing the short-range shaped pellets is disposed radially outward of a stratified domain containing the long-range shaped pellets.

16. The shotshell of claim 1, wherein the plurality of shot pellet shapes are intermixed within the payload of shot pellets.

17. The shotshell of claim 1, wherein the payload of shot pellets does not contain lead.

18. The shotshell of claim 1, wherein when the shotshell payload is discharged from a shotgun to produce a shot pattern, at a distance of 20 yards from the shotgun, the shot pattern of the discharged short-range pellets has at least a 25% greater diameter than the shot pattern of the discharged long-range pellets.

19. The shotshell of claim 1, wherein the short-range shaped pellets comprise lengths of cut wire.

20. The shotshell of claim 1, wherein the oblique cylinder overall shot pellet shape has a cut angle of approximately 45 degrees.

21. The shotshell of claim 20, wherein the short-range shaped pellets comprise lengths of cut wire.

22. The shotshell of claim 1, wherein the short-range shaped pellets are adapted to place less than 45% of the short-range shaped pellets within a 30-inch diameter circle at 40 yards, and further wherein the long-range shaped pellets are adapted to place more than 50% of the long-range shaped pellets within a 30-inch diameter circle at 40 yards.

23. A method of manufacturing the shotshell of claim 1, the method comprising:

providing the shotshell of claim 1 and cutting low-carbon steel wire to form the short-range shaped pellets.

* * * * *